US008438017B2

(12) United States Patent
Jeong et al.

(10) Patent No.: US 8,438,017 B2
(45) Date of Patent: May 7, 2013

(54) METHOD AND APPARATUS FOR ENCODING/DECODING AUDIO SIGNAL USING ADAPTIVE LPC COEFFICIENT INTERPOLATION

(75) Inventors: Jong-hoon Jeong, Suwon-si (KR); Geon-hyoung Lee, Hwaseong-si (KR); Chul-woo Lee, Suwon-si (KR); Nam-suk Lee, Suwon-si (KR); Han-gil Moon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 896 days.

(21) Appl. No.: 12/361,940

(22) Filed: Jan. 29, 2009

(65) Prior Publication Data

US 2009/0198501 A1 Aug. 6, 2009

(30) Foreign Application Priority Data

Jan. 29, 2008 (KR) ..... 10-2008-0009009

(51) Int. Cl.
*G10L 19/00* (2006.01)

(52) U.S. Cl.
USPC ..... 704/219; 704/262; 704/265; 704/267; 704/268

(58) Field of Classification Search ..... None
See application file for complete search history.

(56) References Cited

U.S. PATENT DOCUMENTS

| | | | | |
|---|---|---|---|---|
| 5,499,315 | A | 3/1996 | Meitner et al. | |
| 6,003,001 | A * | 12/1999 | Maeda | 704/223 |
| 2003/0004711 | A1 * | 1/2003 | Koishida et al. | 704/223 |
| 2006/0031075 | A1 | 2/2006 | Oh et al. | |
| 2006/0074642 | A1 * | 4/2006 | You | 704/222 |
| 2007/0179783 | A1 * | 8/2007 | Manjunath et al. | 704/230 |
| 2008/0027719 | A1 * | 1/2008 | Kirshnan et al. | 704/214 |
| 2009/0299737 | A1 * | 12/2009 | Ghenania et al. | 704/219 |

FOREIGN PATENT DOCUMENTS

| | | | |
|---|---|---|---|
| EP | 1160770 | B1 | 5/2005 |
| JP | 5-323999 | A | 12/1993 |
| KR | 10-0498515 | B1 | 9/2005 |

OTHER PUBLICATIONS

Mark Fek et al. Joint speech and audio coding combining sinusoidal modeling and wavelet packets, Eurospeech 2001, Sandinavia, pp. 1-4.

* cited by examiner

*Primary Examiner* — Leonard Saint Cyr
(74) *Attorney, Agent, or Firm* — Sughrue Mion, PLLC

(57) ABSTRACT

Provided are a method and apparatus for encoding or decoding an audio signal by adaptively interpolating a linear predictive coding (LPC) coefficient. In the method and apparatus of encoding or decoding an audio signal, LPC coefficient interpolation is selectively performed depending on whether a transient section is present in a current frame, thereby preventing noise from occurring when interpolating LPC coefficients in the transient section.

22 Claims, 9 Drawing Sheets

METHOD AND APPARATUS FOR ENCODING/DECODING AUDIO SIGNAL USING ADAPTIVE LPC COEFFICIENT INTERPOLATION

CROSS-REFERENCE TO RELATED PATENT APPLICATIONS

This application claims the priority from Korean Patent Application No. 10-2008-0009009, filed on Jan. 29, 2008 in the Korean Intellectual Property Office, the disclosure of which is incorporated herein in its entirety by reference.

BACKGROUND OF THE INVENTION

1. Field of the Invention

Methods and apparatuses consistent with the present invention relate to encoding and decoding an audio signal, and more particularly, to encoding or decoding an audio signal by adaptively interpolating a linear predictive coding (LPC) coefficient depending on whether a transient signal is present in an audio signal in a current frame.

2. Description of the Related Art

In general, an audio signal is processed in units of predetermined time units which are referred to as frames. In case of processing the audio signal in units of frames, a discontinuous point is generated between adjacent frames due to a quantization error and so on, thus deteriorating audio quality. Thus, various algorithms have been proposed in order to prevent adjacent frames from being discontinuous. In the case of LPC, an LPC coefficients of adjacent frames are interpolated in order to prevent audio quality from deteriorating due to a sudden change in LPC coefficients.

Interpolation is performed on the LPC coefficients in order to prevent a change in a source model obtained by analyzing an input audio signal. The interpolation is performed by detecting a change in the trace of poles on a Z-domain in which the LPC coefficients are present. In general, an LPC coefficient is interpolated using line spectral frequency (LSF) transformation or line spectral pair (LSP) transformation.

FIGS. 1A and 1B are reference diagrams for explaining the problem of a related art method of interpolating an LPC coefficient. Referring to FIGS. 1A and 1B, if there is a transient signal that suddenly changes the magnitude of an input audio signal, a signal reconstructed by interpolating an LPC coefficient causes pre-echo. Pre-echo is noise occurring when a previous small-magnitude signal is affected by a large-magnitude signal in the end of a transient section.

Accordingly, a related art method of interpolating an LPC coefficient is disadvantageous in that a change in an LPC coefficient in a transient section increases an error, thus causing noise.

SUMMARY OF THE INVENTION

The present invention provides a method and apparatus for encoding and decoding an audio signal by selectively interpolating an LPC coefficient within a frame containing a transient signal, thereby improving the efficiency of the LPC.

According to an aspect of the present invention, there is provided a method of encoding an audio signal, the method comprising determining a window to be applied to a current frame according to characteristics of an audio signal in the current frame, performing windowing by applying the determined window to the audio signal in the current frame, outputting an LPC coefficient of the audio signal in the current frame by performing LPC analysis on the audio signal in the windowed current frame, and selectively performing LPC coefficient interpolation using the LPC coefficient of the audio signal in the current frame and the LPC coefficient of an audio signal in an adjacent frame, according to characteristics of the audio signal in the current frame.

According to an aspect of the present invention, there is provided an apparatus for encoding an audio signal, the apparatus comprising a window determination unit which determines a window that is to be applied to a current frame according to characteristics of an audio signal in the current frame; a window application unit which performs windowing by applying the determined window to the audio signal in the current frame; an LPC analysis unit which outputs an LPC coefficient of the audio signal in the current frame by performing an LPC analysis on the audio signal in the windowed current frame; and an LPC synthesis unit which selectively performs LPC coefficient interpolation using the LPC coefficient of the audio signal in the current frame and the LPC coefficient of an audio signal in an adjacent frame, according to the characteristics of the audio signal in the current frame.

According to an aspect of the present invention, there is provided a method of decoding an audio signal, the method comprising determining whether a transient section is present in a current frame which is decoded using transient section information included in a bitstream; and selectively interpolating an LPC coefficient of the current frame, which is extracted from the bitstream, and an LPC coefficient of an adjacent frame, depending on whether a transient section is present in the current frame.

According to an aspect of the present invention, there is provided an apparatus for decoding an audio signal, the apparatus comprising a transient location determination unit which determines whether a transient section is present in a current frame which is decoded using transient section information included in a bitstream; and an LPC synthesis performing unit which selectively interpolates an LPC coefficient of the current frame, which is extracted from the bitstream, and an LPC coefficient of an adjacent frame, depending on whether a transient section is present in the current frame.

BRIEF DESCRIPTION OF THE DRAWINGS

The above and other aspects of the present invention will become more apparent by describing in detail exemplary embodiments thereof with reference to the attached drawings in which.

DETAILED DESCRIPTION OF EXEMPLARY EMBODIMENTS OF THE INVENTION

Figure 1A:
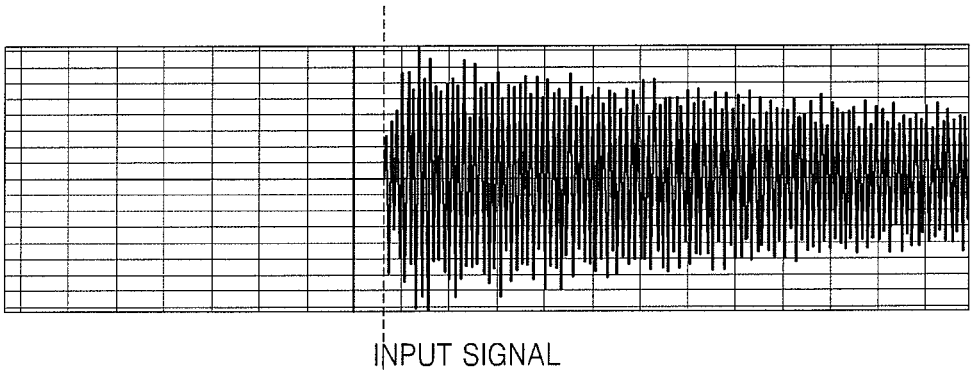
FIG. 1A (RELATED ART)
FIGS. 1A and 1B are reference diagrams for explaining the problem of a related art method of interpolating an LPC coefficient.
Figure 1B:
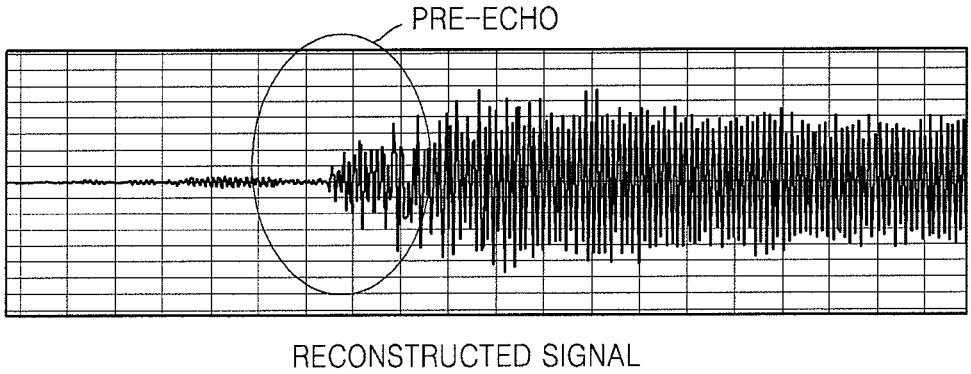
FIG. 1B (RELATED ART)

Hereinafter, exemplary embodiments of the present invention will be described in greater detail with reference to the attached drawings. Like reference numerals denote like elements throughout the drawings.

Figure 2:
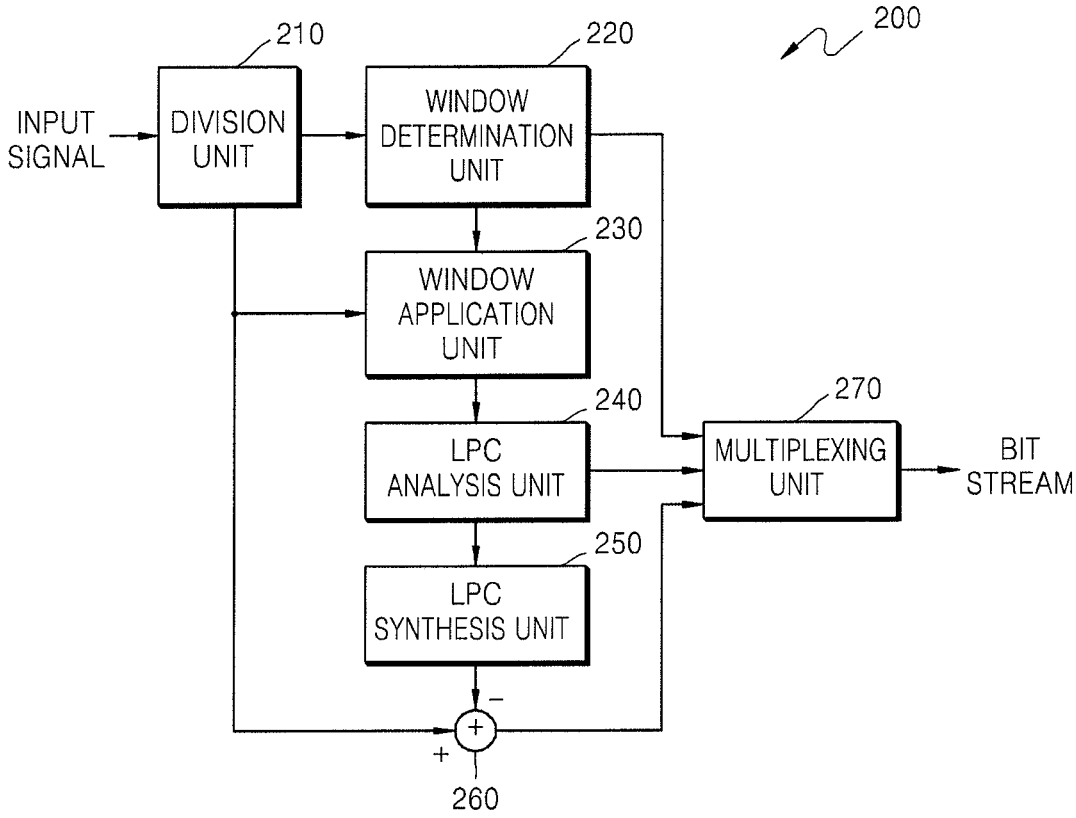
FIG. 2 is a block diagram of an audio signal encoding apparatus according to an exemplary embodiment of the present invention.

FIG. 2 is a block diagram of an audio signal encoding apparatus 200 ("the encoding apparatus") according to an exemplary embodiment of the present invention. Referring to FIG. 2, the encoding apparatus 200 includes a division unit 210, a window determination unit 220, a window application unit 230, an LPC analysis unit 240, an LPC synthesis unit 250, a subtraction unit 260, and a multiplexing unit 270.

The division unit 210 divides an input audio signal into units of frames of a predetermined length. The window determination unit 220 determines a window that is to be applied to a current frame according to the audio signal characteristics of the current frame. For continuous processing of the audio signal, the division unit 210 divides the audio signal into units of frames of a predetermined length. In general, a tapered window, such as a hamming window, which gradually increases and then decreases, is used as a window, instead of a rectangular window, as defined in the following Equation (1):

$$w(n) = \begin{cases} 0.54 - 0.46\cos\left(\frac{2\pi n}{N_w - 1}\right), & 0 \le n \le N_w - 1, \\ 0, & \text{otherwise.} \end{cases} \quad (1)$$

A tapered window, such as a hamming window, is used because the spectral characteristics thereof are better than those of a rectangular window. However, windows, such as a hamming window, overlap with one another between adjacent frames in the temporal domain. Pre-echo that occurs when interpolating an LPC coefficient in a transient section is caused since a signal generated in the head of the transient section is affected by a signal in the end thereof due to such window overlapping. Thus, the window determination unit 220 primarily determines the shape of windows to change based on the transient section, so that the windows can be separated from one another with respect to the transient section in which signals having different characteristics are connected to one another, thereby preventing signals generated in the transient section from being discontinuous.

Figure 3:
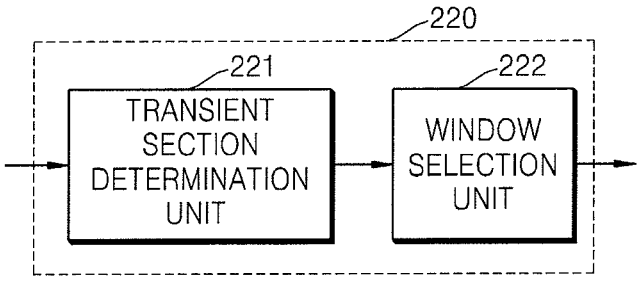
FIG. 3 is a block diagram illustrating in detail the window determination unit of FIG. 2 according to an exemplary embodiment of the present invention.

FIG. 3 is a block diagram illustrating in detail the window determination unit 220 of FIG. 2 according to an exemplary embodiment of the present invention. Referring to FIG. 3, the window determination unit 220 includes a transient section determination unit 221 and a window selection unit 222.

The transient section determination unit 221 divides an audio signal in a current frame into a plurality of sub frames, and calculates the similarity between the audio signals of adjacent sub frames or calculates the difference between the average energy levels of the sub frames in order to determine whether a transient section is present in the current frame. The transient section determination unit 221 may be omitted when an audio signal encoder 200 itself has a function of determining whether a transient section is present. For example, the transient section determination unit 221 may be omitted when a wave coder, such as an Advanced Audio Coding (AAC) device, an MP3 player, or a parametric coder has a function of determining whether a transient section is present.

If it is determined that a transient section is present in the current frame, the window selection unit 222 selects the shape and size of a window that is to be applied to the current frame so that the window overlaps with windows of the other frames only in the transient section, but does not overlap with windows of the other frames in the other sections. If it is determined that a transient section is not present in the current frame, the window selection unit 222 directly selects a predetermined window without changing the shape and size of a window that is to be applied. A method of determining a window to be applied to a current frame according to an exemplary embodiment of the present invention will now be described in greater detail with reference to FIGS. 4 through 6.

Figure 4:
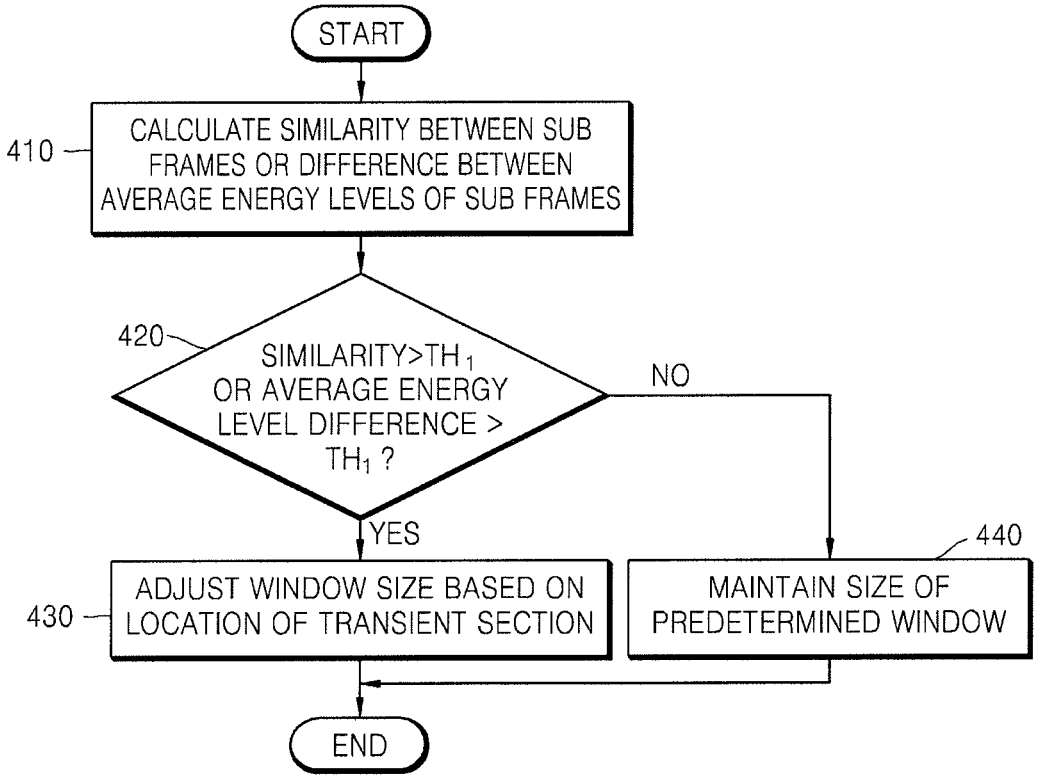
FIG. 4 is a flowchart illustrating a method of determining a window to be applied to a current frame according to an exemplary embodiment of the present invention.
Figure 5:
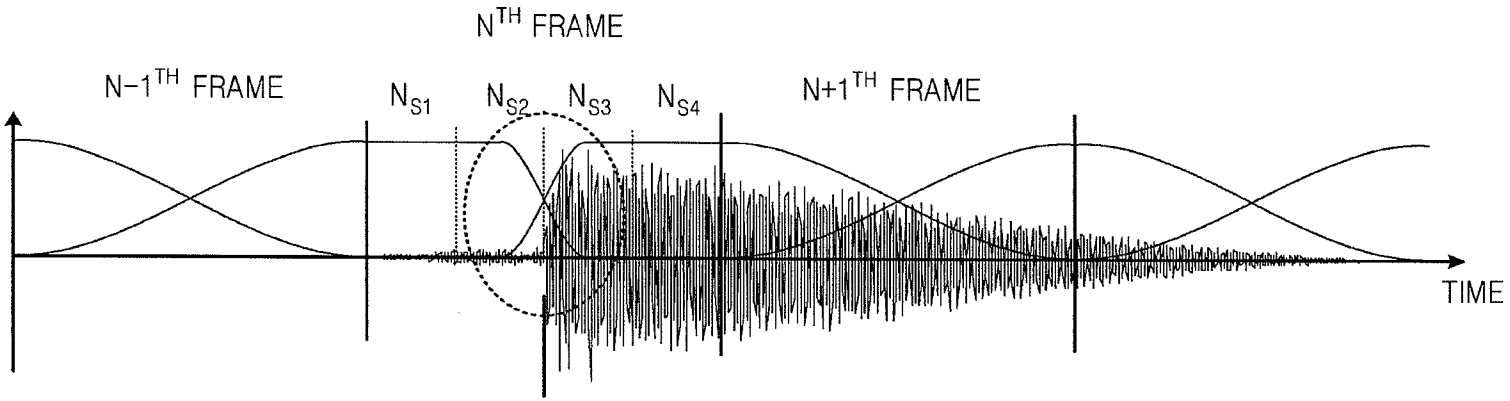
FIG. 5 is a reference diagram for explaining a method of determining whether a transient section is present in a current frame according to an exemplary embodiment of the present invention.

FIG. 4 is a flowchart illustrating a method of determining a window to be applied to a current frame according to an exemplary embodiment of the present invention. FIG. 5 is a reference diagram for explaining a method of determining whether a transient section is present in a current frame according to an exemplary embodiment of the present invention.

Referring to FIGS. 3 and 4, in operation 410, the transient section determination unit 221 divides a current frame into a plurality of sub frames, and calculates the similarity between the audio signals of adjacent sub frames or calculates the difference between the average energy levels of adjacent sub frames. For example, referring to FIG. 5, the transient section determination unit 221 divides a current $N^{th}$ frame into four sub frames $N_{s1}$, $N_{s2}$, $N_{s3}$, and $N_{s4}$. In operation 420, the transient section determination unit 221 calculates the correlation between adjacent sub frames in order to determine the extent of similarity between signals in the adjacent sub frames. For example, the transient section determination unit 221 calculates the correlation $R(N_{s2}, N_{s3})$ between the adjacent second and third sub frames $N_{s2}$ and $N_{s3}$, according to Equation (2) as follows:

$$R(Ns_2, Ns_3) = \frac{C(Ns_2, Ns_3)}{\sqrt{C(Ns_2, Ns_2)C(Ns_3, Ns_3)}}, \quad (2)$$

wherein $C(N_{s2}, N_{s3}) = E[(N_{s2} - m_{s2})(N_{s3} - m_{s3})]$, and $m_{s2}$ and $m_{s3}$ respectively denote the average values of signals in the second and third sub frames $N_{s2}$ and $N_{s3}$. Referring to Equation (2), the more the absolute value of $R(N_{s2}, N_{s3})$ approximates "1", the more the signals in the sub frames $N_{s2}$ and $N_{s3}$ are similar to each other, and the more the absolute value of $R(N_{s2}, N_{s3})$ approximates "0", the more the characteristics of the signals in the sub frames $N_{s2}$ and $N_{s3}$ are different from each other. That is, when the correlation between adjacent sub frames is less than a predetermined threshold Th1, it is possible to determine that a transient section is present in the current frame. Referring to FIG. 5, the interval between the second sub frame $N_{s2}$ and the third sub frame $N_{s3}$ corresponds to a transient section in which signal amplitude sharply changes, and thus, the absolute value of $R(N_{s2}, N_{s3})$ approximates "0" that is less than the predetermined threshold Th1.

Similarly, the transient section determination unit 221 may calculate the average energy level of each of the four sub frames $N_{s1}$, $N_{s2}$, $N_{s3}$ and $N_{s4}$, and determine that a transient section is present in adjacent sub frames if the difference between the average levels of the adjacent sub frames is greater than a predetermined threshold Th2.

Also, the transient section determination unit 221 may determine a location between sub frames that are determined to have different signal characteristics as a transient location and then insert information regarding the transient location into an encoded bitstream that is to be transmitted, so that a decoder can recognize the transient location in the current frame. In this case, in order to transmit the information regarding the transient location included in the current frame with a minimum of bits, the location of adjacent sub frames can be expressed as one of $(\log_2(SF)-1)$ locations by dividing the current $N^{th}$ frame into SF sub frames, where SF denotes a predetermined positive integer that is an exponential multiplier of 2. More specifically, if a transient section is not present in the current frame, the transient section determination unit 221 may transmit location information of the transient section via a bitstream by allocating "0" to the current frame and a value ranging from 1 to $(\log_2(SF)-1)$ to locations between the other sub frames. FIG. 5 illustrates a case where SF is a value of 4. For example, in this case, the transient section information of the current frame can be expressed as two-bit additional information with respect to four cases, i.e., where the transient section is located between the first and second sub frames $N_{s1}$ and $N_{s2}$, where the transient section is located between the second and third sub frames $N_{s2}$ and $N_{s3}$, where the transient section is located between the third and fourth sub frames $N_{s3}$ and $N_{s4}$, and where no transient section is present.

Referring to FIG. 4, in operation 430, if it is determined that a transient section is present in the current frame, the window selection unit 222 adjusts the shapes of windows of the current frame and an adjacent frame based on the location of the transient section in the current frame, so that a part of the window of the current frame that overlaps with the window of the adjacent frame is limited to the transient section in the current frame. In other words, if the current frame includes a transient section, the window selection unit 222 determines the size and shape of a window that is to be applied to the current frame, so that the window of the current frame can overlap with a window of another frame only in the transient section and have a flat shape without overlapping with other windows in the other sections.

In operation 440, if it is determined that the current frame does not include a transient section, the window selection unit 222 maintains the size and shape of a predetermined window. For example, the window selection unit 222 directly applies a predetermined hamming window to the current frame without adjusting the size and shape of the hamming window.

Figure 6:
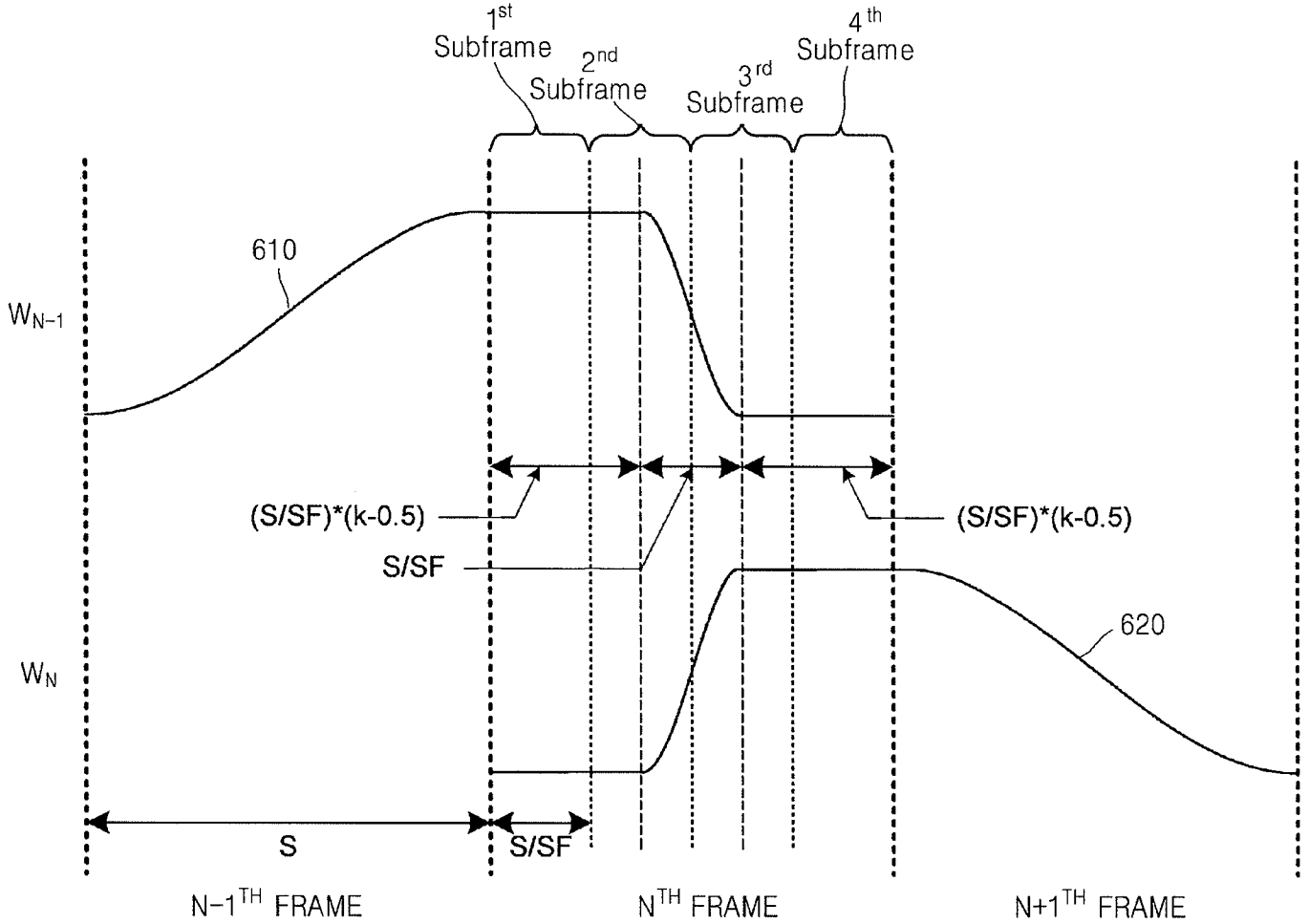
FIG. 6 is a reference diagram for explaining a method of determining a window to be applied to a current frame according to an exemplary embodiment of the present invention.

FIG. 6 is a reference diagram for explaining a method of determining a window to be applied to a current frame according to an exemplary embodiment of the present invention. In FIG. 6, S denotes the length of a frame and SF denotes the total number of sub frames.

Referring to FIGS. 3 and 6, it is assumed that a current $N^{th}$ frame is divided into four sub frames and a transient section is present between second and third sub frames. If the transient section determination unit 221 determines that a transient section is present between two adjacent sub frames, the window selection unit 222 adjusts window size by reducing or increasing the sizes of windows overlapping with each other in a section from the center of one of the sub frames to the center of the other sub frame, so that the windows can overlap with each other only within the section. For example, referring to FIG. 6, the $N^{th}$ frame has a section in which two windows 610 and 620 overlap with each other. The window selection unit 222 adjusts the sizes of the windows 610 and 620 so that a section of the $N^{th}$ frame, in which the windows 610 and 620 overlap with each other can be limited to a transient section. In this case, signal characteristics before and after the transient section are separated from one another and the parts of the windows 610 and 620 that overlap with each other are applied to the transient section, thereby guaranteeing signal continuity.

Referring to FIG. 2, if the window selection unit 222 selects a window as described above, the window application unit 230 performs windowing in which the audio signal in the current frame is multiplied by the selected window.

The LPC analysis unit 240 outputs the LPC coefficient of an audio signal in the current frame by performing an LPC analysis on the audio signal in the windowed current frame. In this case, the covariance method, the autocorrelation method, the Lattice filter, or the Levinson-Durbin algorithm may be used in order to extract and output LPC coefficients from the audio signal in the current frame.

More specifically, the LPC analysis unit 240 assumes that an audio signal sample value s(n) of the current frame is modeled using previous p audio signal samples s(n−1), s(n−2), . . . , s(n−p), where p is a positive integer, according to Equation (3) as follows:

$$s(n) = \sum_{i=1}^{p} a_i s(n-i) + Gu(n), \tag{3}$$

wherein u(n) denotes a predicted error when the audio signal sample value of the current frame is predicted from the p audio signal samples through the LPC analysis, which is also referred to as an excitation signal or a residual signal. G denotes a gain according to the energy level of a residual signal, $a_i$ denotes an LPC coefficient, and p denotes the degree of the LPC coefficient, which generally ranges from 10 to 16.

Equation (3) is transformed into the following equation through z-conversion as shown Equation (4) as follows:

$$H(z) = \frac{s(z)}{u(z)} = \frac{G}{1 - \sum_{i=1}^{p} a_i z^{-1}} = \frac{G}{A(z)}, \tag{4}$$

wherein the denominator of a transfer function H(z) is expressed as A(z).

The LPC synthesis unit 250 generates a predicted signal of the audio signal in the current frame by using the LPC coefficients. In detail, if the current frame does not include a transient section, the LPC synthesis unit 250 generates an interpolated LPC coefficient by interpolating LPC coefficients of the current frame and a previous frame. Then, the LPC synthesis unit 250 performs LPC synthesis using the interpolated LPC coefficient in order to generate a predicted signal of the audio signal in the current frame.

If the current frame includes a transient section, the LPC synthesis unit 250 performs LPC synthesis using an LPC coefficient of an adjacent previous frame in order to generate a first predicted audio signal, and performs LPC synthesis using the LPC coefficient of the current frame in order to generate a second predicted audio signal. Then, the LPC synthesis unit 250 performs an overlap and addition operation on the first and second predicted audio signals in order to generate a predicted signal of the audio signal in the current frame.

Figure 9:
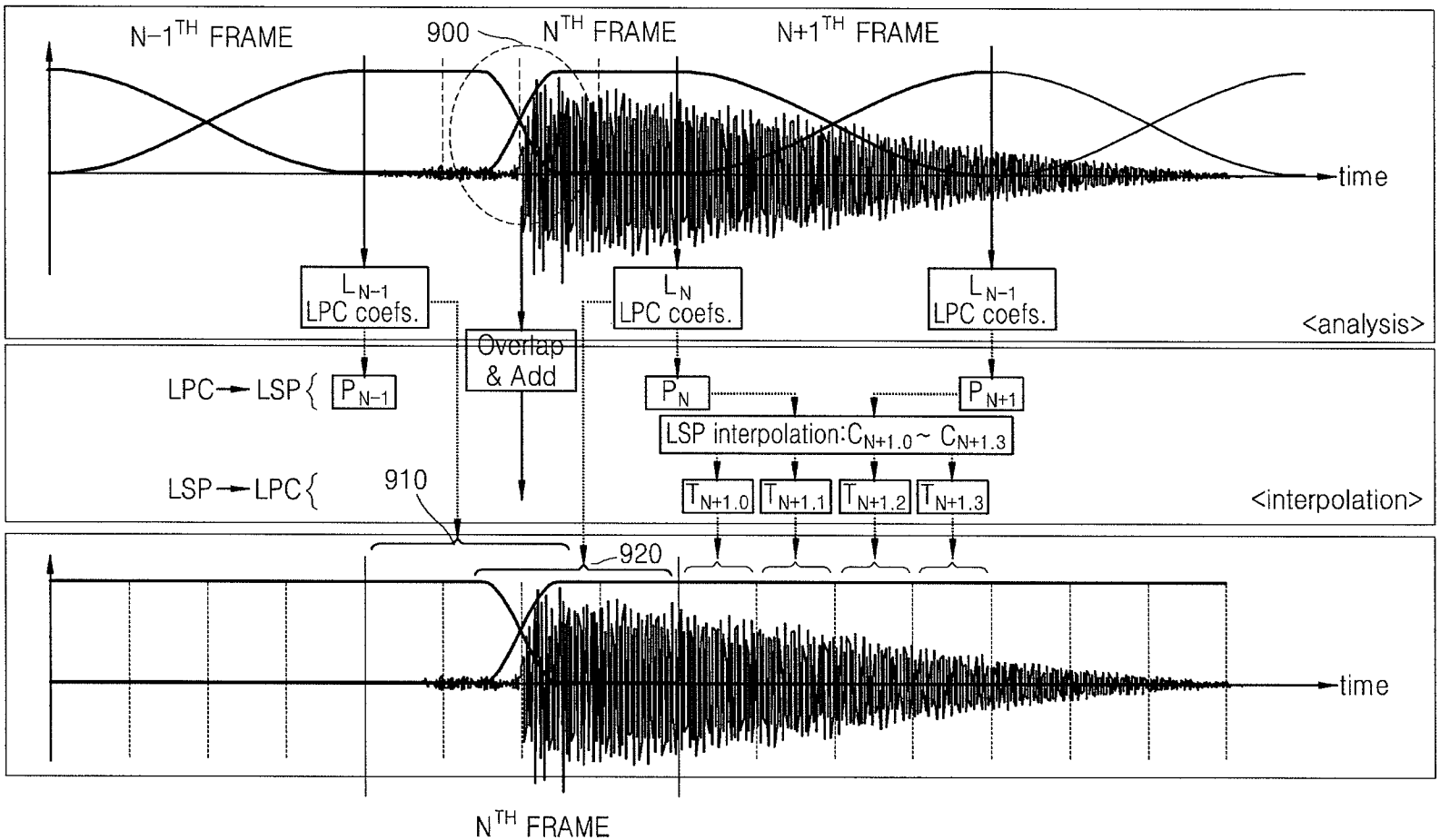
FIG. 9 is a reference diagram for explaining a method of selectively interpolating an LPC coefficient and performing an overlap and addition operation thereon according to an exemplary embodiment of the present invention.

FIG. 9 is a reference diagram for explaining a method of selectively interpolating an LPC coefficient and performing an overlap and addition operation thereon, according to an exemplary embodiment of the present invention. Referring to FIGS. 2 and 9, if LPC synthesis is performed on a frame, such as an $N+1^{th}$ frame, which does not have a transient section, the LPC synthesis unit 250 respectively performs LSP transformation on LPC coefficients $L_N$ in the temporal domain extracted from an $N^{th}$ frame and an LPC coefficients $L_{N+1}$ in the temporal domain, extracted from an $N+1^{th}$ frame, into LSP coefficients $P_N$ and $P_{N+1}$ in the frequency domain. Then, the LPC synthesis unit 250 allocates weights to the LSP coefficients $P_N$ and $P_{N+1}$ and interpolates the resultants, thus obtaining LSP coefficients $C_{N+1,0}$, $C_{N+1,1}$, $C_{N+1,2}$, and $C_{N+1,3}$ of each sub frame. Here, it is assumed that each frame is divided into four sub frames. Next, the LPC synthesis unit 250 transforms the LSP coefficients $C_{N+1,0}$, $C_{N+1,1}$, $C_{N+1,2}$, and $C_{N+1,3}$ of each sub frame into LPC coefficients again so as to obtain LPC coefficients $T_{N+1,0}$, $T_{N+1,1}$, $T_{N+1,2}$, and $T_{N+1,3}$ of each sub frame in the temporal domain, and then performs LPC synthesis using the obtained LPC coefficients, thus obtaining a predicted audio signal in the $N+1^{th}$ frame.

However, if an LPC analysis is performed on an audio signal in a frame, such as the $N^{th}$ frame, which includes a transient section 900, the LPC synthesis unit 250 does not interpolate the above LPC coefficients. Instead, the LPC synthesis unit 250 performs LPC synthesis using the LPC coefficients $L_{N-1}$ extracted from the audio signal in the $N-1^{th}$ frame in order to generate a first predicted audio signal, and performs LPC synthesis using the LPC coefficients $L_N$ extracted from the audio signal in the $N^{th}$ frame in order to generate a second predicted audio signal. Next, the LPC synthesis unit 250 performs an overlap and addition operation on the first and second predicted audio signals. As illustrated in FIG. 9, a section of the first predicted audio signal 910 and a section of the second predicted audio signal 920, which belong to the $N^{th}$ frame, overlap with each other only in the transient section 900.

Referring to FIG. 2, the subtraction unit 260 generates a residual signal by calculating the difference between the predicted signal received from the LPC synthesis unit 250 and an input audio signal.

The multiplexing unit 270 multiplexes location information of the transient section determined by the window determination unit 220, the LPC coefficients of the current frame, and information regarding the residual signal into a bitstream.

Figure 7:
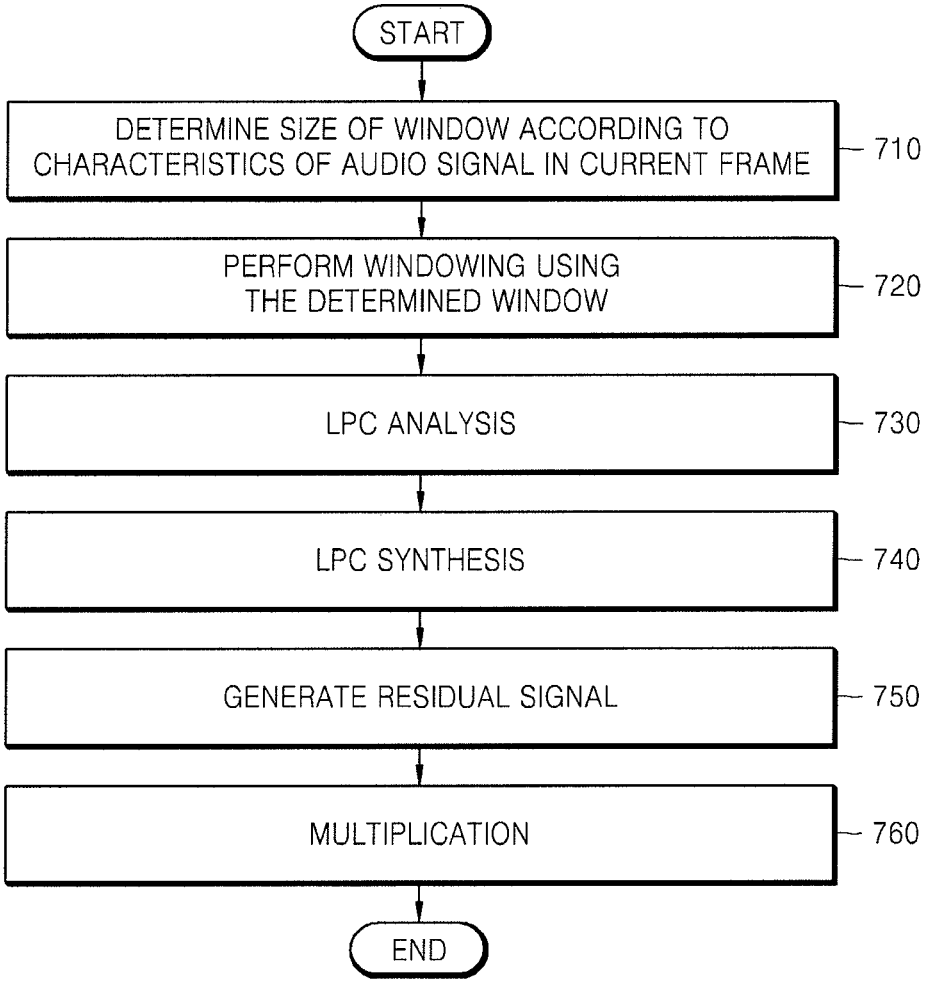
FIG. 7 is a flowchart illustrating an audio signal encoding apparatus according to an exemplary embodiment of the present invention.

FIG. 7 is a flowchart illustrating an audio signal encoding method according to an exemplary embodiment of the present invention. In operation 710, a window that is to be applied to a current frame is determined according to the characteristics of an audio signal in the current frame. As described above, it is possible to divide the current frame into a plurality of sub frames and determine whether a transient section is present in the current frame by calculating the similarity between the audio signal of the adjacent sub frames or calculating the difference between the average energy levels of adjacent sub frames. If a transient section is not present, a predetermined window is directly used. If a transient section is present, a window that is to be applied to the current frame is determined in such a manner that the window overlaps with windows of the other frames only in the transient section but not in the other sections.

In operation 720, windowing is performed by applying the determined window to the audio signal in the current frame.

In operation 730, an LPC analysis is performed on the audio signal in the windowed current frame in order to output an LPC coefficient of the audio signal.

In operation 740, in order to generate a predicted signal of the audio signal in the current frame, LPC synthesis is performed by selectively performing LPC coefficient interpolation using the LPC coefficients of the audio signal in the current frame and LPC coefficients of the audio signal in an adjacent frame, depending on the characteristics of the audio signal in the current frame, such as whether a transient section is present in the current frame. In detail, if a transient section is not present in the current frame, interpolated LPC coefficients are generated by interpolating the LPC coefficients of the current frame and a previous frame. If a transient section is present in the current frame, interpolation is not performed. Next, a predicted signal of the audio signal in the current frame is generated by performing LPC synthesis using the interpolated LPC coefficients.

If a transient section is present, a first predicted audio signal is generated by performing LPC synthesis using LPC coefficients of an adjacent frame without interpolating, and a second predicted audio signal is generated by performing LPC synthesis using the LPC coefficients of the current frame. Next, the overlap and addition operation is performed on the first and second predicted audio signals, thus obtaining a predicted signal of the audio signal in the current frame.

In operation 750, a residual signal is generated by calculating the difference between the signal predicted through LPC synthesis and the input audio signal.

In operation 760, the transient section information, the LPC coefficient and the information regarding the residual signal are multiplexed into a bitstream.

Figure 8:
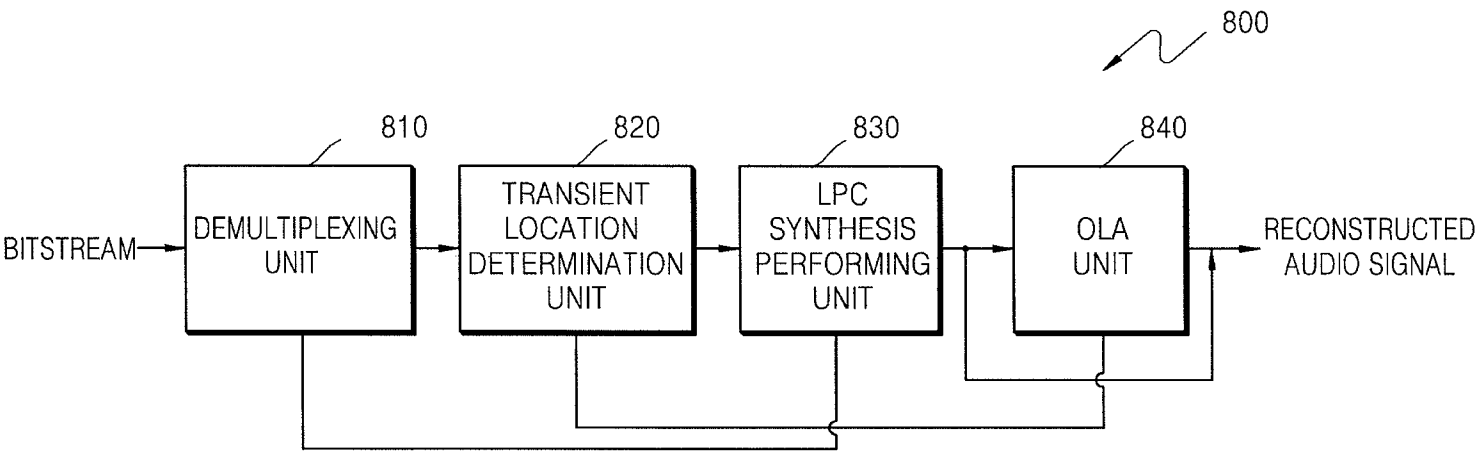
FIG. 8 is a block diagram of an audio signal decoding apparatus according to an exemplary embodiment of the present invention.

FIG. 8 is a block diagram of an audio signal decoding apparatus 800 ("the decoding apparatus") according to an exemplary embodiment of the present invention. Referring to FIG. 8, the decoding apparatus 800 includes a demultiplexing unit 810, a transient location determination unit 820, an LPC synthesis performing unit 830, and an overlapping and addition (OLA) unit 840.

The demultiplexing unit 810 demultiplexes a bitstream in order to extract transient section information, an LPC coefficient, and residual information from a current frame that is to be decoded.

The transient location determination unit 820 determines whether a transient section is present in the current frame that is to be decoded, using the extracted transient section information.

The operation of the LPC synthesis unit 830 is similar to that of the LPC synthesis unit 250 illustrated in FIG. 2. That is, the LPC synthesis performing unit 830 selectively interpolates the LPC coefficient of the current frame, which is extracted from the bitstream, and the LPC coefficient of an adjacent frame, depending on whether a transient section is present in the current frame. In detail, if a transient section is not present in the current frame, the LPC synthesis unit 830 generates an interpolated LPC coefficient by interpolating the LPC coefficients of the current frame and a previous frame, and decodes an audio signal in the current frame by performing LPC synthesis using the interpolated LPC coefficient.

If a transient section is present in the current frame, the LPC synthesis unit 830 generates a first predicted audio signal by performing LPC synthesis using the LPC coefficient of the adjacent frame, and the LPC coefficient of a second predicted audio signal by performing LPC synthesis using the LPC coefficient of the current frame. The OLA unit 840 decodes an audio signal in the current frame by performing an overlap and addition operation in order to combine the first and second predicted audio signals.

Figure 10:
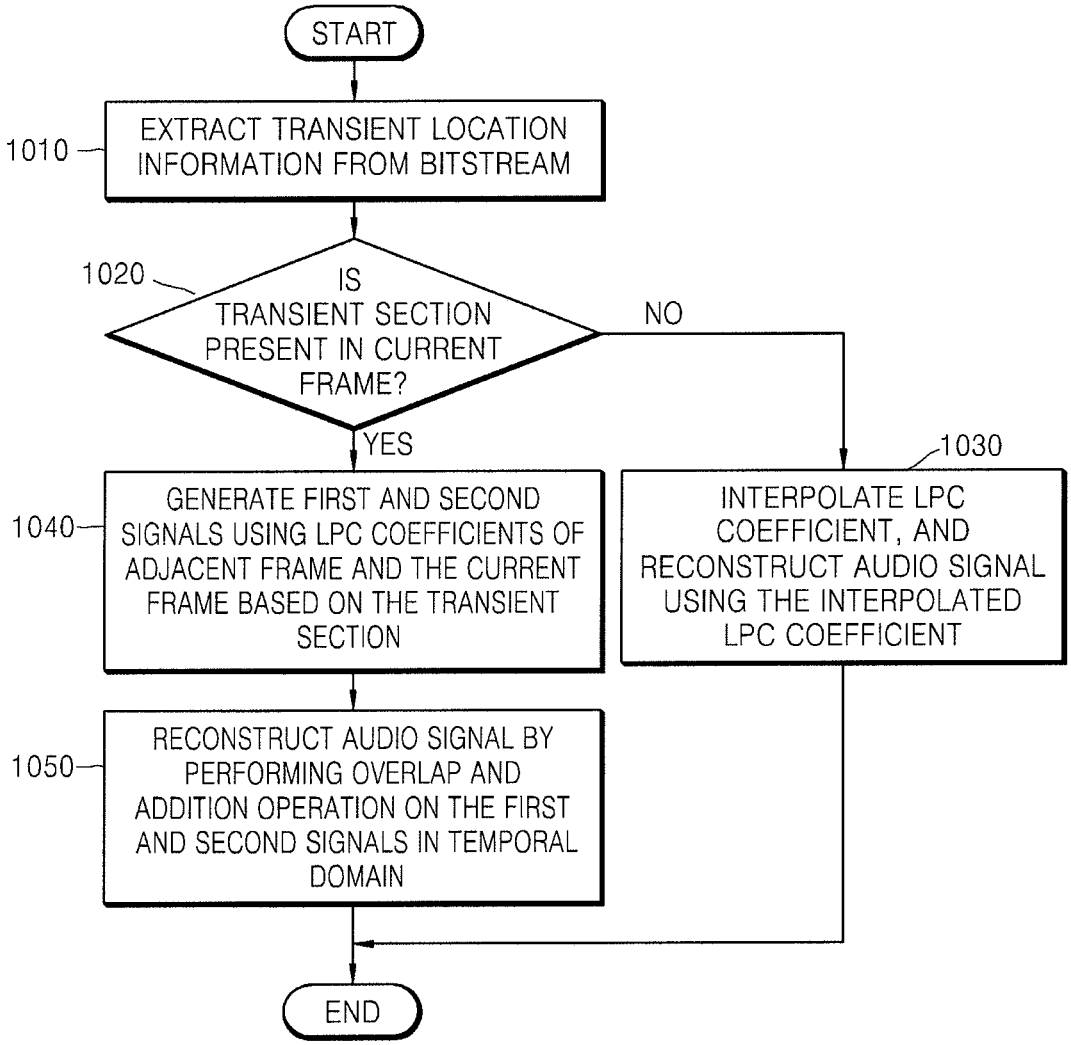
FIG. 10 is a flowchart illustrating an audio signal decoding method according to an exemplary embodiment of the present invention.

FIG. 10 is a flowchart illustrating an audio signal decoding method ("the decoding method") according to an exemplary embodiment of the present invention. Referring to FIG. 10, in operation 1010, the transient section information is extracted from a bitstream. In operation 1020, it is determined whether a transient section is present in a current frame that is to be decoded, using the extracted transient section information.

If it is determined in operation 1020 that a transient section is not present in the current frame, in operation 1030, an interpolated LPC coefficient is generated by interpolating the LPC coefficient of the current frame and the LPC coefficient of a previous frame, and then an audio signal in the current frame is decoded by performing LPC synthesis using the interpolated LPC coefficient.

If it is determined in operation 1020 that a transient section is present in the current frame, in operation 1040, a first predicted audio signal is generated by performing LPC synthesis using an LPC coefficient of an adjacent frame, and a second predicted audio signal is generated by performing LPC synthesis using the LPC coefficient of the current frame. In operation 1050, an audio signal in the current frame is decoded by combining the first and second predicted audio signals by performing an overlap and addition operation.

The present invention can be embodied as computer readable code in a computer readable medium. Here, the computer readable medium may be any recording apparatus capable of storing data that is read by a computer system, such as, a read-only memory (ROM), a random access memory (RAM), a compact disc (CD)-ROM, a magnetic tape, a floppy disk, an optical data storage device, and so on. The computer readable medium can be distributed among computer systems that are interconnected through a network, and the present invention may be stored and implemented as computer readable code in the distributed system.

According to the above exemplary embodiments of the present invention, window size is changed adaptively based on a transient section, thereby removing noise, e.g., pre-echo, which occurs in the transient section when interpolating LPC coefficients. Also, an audio signal in the transient section is combined with a signal obtained by performing LPC synthesis using LPC coefficients of adjacent frames without interpolating LPC coefficients of the signal in the transient section, thereby preventing audio signals in the transient section from being discontinuous and improving audio quality.

While this invention has been particularly shown and described with reference to exemplary embodiments thereof, it will be understood by those skilled in the art that various changes in form and details may be made therein without departing from the spirit and scope of the invention as defined by the following claims.

What is claimed is:

1. A method of encoding an audio signal, the method comprising:

determining a window to be applied to a current frame according to whether a transient section is present in the current frame;

performing windowing by applying the window to the audio signal in the current frame;

outputting a linear predictive coding (LPC) coefficient of the audio signal in the current frame by performing LPC analysis on the audio signal in the current frame; and interpolating the LPC coefficient of the audio signal in the current frame and an LPC coefficient of the audio signal in an adjacent frame in order to generate an interpolated LPC coefficient if it is determined that the transient section is not present in the current frame, and wherein the LPC coefficient of the audio signal in the current frame and the LPC coefficient of the audio signal in the adjacent frame are not interpolated if the transient section is present in the current frame.

2. The method of claim 1, wherein if the transient section is present in the current frame, the window applied to the current frame overlaps with another window that is applied to the adjacent frame, and the windows overlap only in the transient section.

3. The method of claim 1, wherein the determining the window to be applied to the current frame comprises:

dividing the audio signal in the current frame into a plurality of sub frames;

determining whether the transient section is present in the current frame based on characteristics of an audio signal in each of the sub frames; and determining a size of the window that is to be applied to the current frame according to a result of determining whether the transient section is present in the current frame.

4. The method of claim 3, wherein the determining whether the transient section is present comprises determining whether the transient window is present based on at least one of a similarity between the audio signals in adjacent sub frames and a difference between average energy levels the audio signals in adjacent sub frames.

5. The method of claim 3, further comprising, if it is determined that the transient section is present in the current frame, determining a location of the transient section based on the locations of sub frames and adding location information of the transient section to a predetermined part of an encoded bitstream.

6. The method of claim 3, wherein the selectively performing of LPC coefficient interpolation comprises interpolating the LPC coefficient of the audio signal in the current frame and an LPC coefficient of the audio signal in a previous frame in order to generate an interpolated LPC coefficient if it is determined that the transient section is not present in the current frame, and wherein the LPC coefficient of the audio signal in the current frame and the LPC coefficient of the audio signal in the previous frame are not interpolated if the transient section is present in the current frame.

7. The method of claim 6, further comprising:

generating a predicted signal of the audio signal in the current frame by performing LPC synthesis using the interpolated LPC coefficient; and calculating a residual signal between the predicted signal and the original audio signal.

8. The method of claim 6, further comprising, if it is determined that the transient section is present in the current frame:

generating a first predicted audio signal by performing LPC synthesis using the LPC coefficient of the audio signal in the adjacent frame without performing interpolation;

generating a second predicted audio signal by performing LPC synthesis using the LPC coefficient of the audio signal in the current frame;

generating a predicted signal of the audio signal in the current frame by performing an overlap and addition operation on the first and second predicted audio signals in order to combine the first and second predicted audio signals; and calculating a residual signal between the predicted signal and the original audio signal.

9. An apparatus for encoding an audio signal, the apparatus comprising a processor which implements:

a window determination unit which determines a window that is to be applied to a current frame according to whether a transient section is present in the current frame;

a window application unit which performs windowing by applying the window to the audio signal in the current frame;

a linear predictive coding (LPC) analysis unit which outputs an LPC coefficient of the audio signal in the current frame by performing an LPC analysis on the audio signal in the current frame; and an LPC synthesis unit which interpolates the LPC coefficient of the audio signal in the current frame and an LPC coefficient of the audio signal in an adjacent frame in order to generate an interpolated LPC coefficient if a transient section is not present in the current frame, and the LPC synthesis unit does not interpolate the LPC coefficient of the audio signal in the current frame and the LPC coefficient of the audio signal in the adjacent frame if the transient section is present in the current frame.

10. The apparatus of claim 9, wherein if the transient section is present in the current frame, the window determination unit determines a shape of the window to be applied to the current frame in such a manner that the window overlaps with another window that is applied to the adjacent frame, and the windows overlap only in the transient section.

11. The apparatus of claim 9, wherein the current frame is divided into a plurality of sub frames, and the window determination unit determines whether the transient section is present in the current frame based on at least one of a similarity between the audio signals in adjacent sub frames and a difference between average energy levels in the adjacent sub frames and determines size of the window to be applied to the current frame based on whether the transient section is present.

12. The apparatus of claim 9, wherein the current frame is divided into a plurality of sub frames and if the transient section is present in the current frame, the window determination unit determines a location of the transient section based on the locations of the sub frames and adds a location information of the transient section to a predetermined part of an encoded bitstream.

13. The apparatus of claim 9, wherein the LPC synthesis unit interpolates the LPC coefficient of the audio signal in the current frame and an LPC coefficient of the audio signal in a previous frame in order to generate an interpolated LPC coefficient if the transient section is not present in the current frame, and the LPC synthesis unit does not perform interpolation when the transient section is present in the current frame.

14. The apparatus of claim 13, wherein if the transient section is not present, the LPC synthesis unit generates a predicted signal of the audio signal in the current frame by performing LPC synthesis using the interpolated LPC coefficient.

15. The apparatus of claim 13, wherein if the transient section is present in the current frame, the LPC synthesis unit generates a first predicted audio signal by performing LPC synthesis using the LPC coefficient of the audio signal in the adjacent frame, generates a second predicted audio signal by performing LPC synthesis using the LPC coefficient of the audio signal in the current frame, and generates a predicted signal of the audio signal in the current frame by performing an overlap and addition operation on the first and second predicted audio signals in order to combine the first and second predicted audio signals.

16. A method of decoding an audio signal, the method comprising:

determining whether a transient section is present in a current frame which is decoded using a transient section information included in a bitstream; and interpolating a linear predictive coding (LPC) coefficient of an audio signal in the current frame, which is extracted from the bitstream, and an LPC coefficient of an audio signal in an adjacent frame if the transient section is not present in the current frame, and wherein the LPC coefficient of the audio signal in the current frame and the LPC coefficient of the audio signal in the adjacent frame are not interpolated if the transient section is present in the current frame.

17. The method of claim 16, wherein the selectively interpolating the LPC coefficients comprises, if the transient section is present in the current frame:

generating a first predicted audio signal by performing LPC synthesis using the LPC coefficient of the audio signal in the adjacent frame;

generating a second predicted audio signal by performing LPC synthesis using the LPC coefficient of the audio signal in the current frame; and decoding the audio signal in the current frame by performing an overlap and addition operation on the first and second predicted audio signals in order to combine the first and second predicted audio signals.

18. The method of claim 16, wherein the selectively interpolating of the LPC coefficients comprises, if it is determined that the transient section is not present in the current frame:

generating an interpolated LPC coefficient by interpolating the LPC coefficient of the audio signal in the current frame and an LPC coefficient of an audio signal in a previous frame; and decoding the audio signal in the current frame by performing LPC synthesis using the interpolated LPC coefficient.

19. An apparatus for decoding an audio signal, the apparatus comprising a processor which implements:

a transient location determination unit which determines whether a transient section is present in a current frame which is decoded using transient section information included in a bitstream; and a linear predictive coding (LPC) synthesis performing unit which interpolates an LPC coefficient of an audio signal in the current frame, which is extracted from the bitstream, and an LPC coefficient of an audio signal in an adjacent frame if the transient section is not present in the current frame, and wherein the LPC synthesis performing unit does not interpolate the LPC coefficient of the audio signal in the current frame and the LPC coefficient of the audio signal in the adjacent frame if the transient section is present in the current frame.

20. The apparatus of claim 19, wherein if the transient section is present in the current frame, the LPC synthesis performing unit generates a first predicted audio signal by performing LPC synthesis using the LPC coefficient of the audio signal in the adjacent frame, and generates a second predicted audio signal by performing LPC synthesis using the LPC coefficient of the audio signal in the current frame.

21. The apparatus of claim 20, further comprising:

an overlap and addition unit which decodes the audio signal in the current frame by performing an overlap and addition operation on the first and second predicted audio signals in order to combine the first and second predicted audio signals.

22. The apparatus of claim 19, wherein if the transient location determination unit determines that the transient section is not present in the current frame, the LPC synthesis performing unit generates an interpolated LPC coefficient by interpolating the LPC coefficient of the audio signal in the current frame and an LPC coefficient of an audio signal in a previous frame, and decodes the audio signal in the current frame by performing LPC synthesis using the interpolated LPC coefficient.

* * * * *